US010231897B2

(12) United States Patent
Tse et al.

(10) Patent No.: US 10,231,897 B2
(45) Date of Patent: Mar. 19, 2019

(54) METHODS, DEVICES, AND SYSTEMS FOR INHIBITING OCULAR REFRACTIVE DISORDERS FROM PROGRESSING

(71) Applicant: THE HONG KONG POLYTECHNIC UNIVERSITY, Kowloon (HK)

(72) Inventors: Yan Yin Tse, Kowloon (HK); Siu Yin Lam, Kowloon (HK); Chi Ho To, Kowloon (HK)

(73) Assignee: THE HONG KONG POLYTECHNIC UNIVERSITY, Kowloom (HK)

( * ) Notice: Subject to any disclaimer, the term of this patent is extended or adjusted under 35 U.S.C. 154(b) by 0 days.

(21) Appl. No.: 15/837,907

(22) Filed: Dec. 11, 2017

(65) Prior Publication Data

US 2018/0161231 A1 Jun. 14, 2018

Related U.S. Application Data

(60) Continuation-in-part of application No. 15/009,224, filed on Jan. 28, 2016, now Pat. No. 9,918,894, which is a division of application No. 13/568,016, filed on Aug. 6, 2012, now abandoned.

(51) Int. Cl.
*A61H 5/00* (2006.01)
*A61H 99/00* (2006.01)

(52) U.S. Cl.
CPC ..... *A61H 5/00* (2013.01); *A61H 99/00* (2013.01)

(58) Field of Classification Search
CPC ..... A61H 5/00; A61H 99/00
USPC ..... 351/200, 203, 246
See application file for complete search history.

(56) References Cited

U.S. PATENT DOCUMENTS

| | | | | |
|---|---|---|---|---|
| 2,388,858 | A | 11/1945 | Macneille | |
| 4,408,846 | A | 10/1983 | Balliet | |
| 4,533,221 | A | 8/1985 | Trachtman | |
| 4,660,945 | A | 4/1987 | Trachtman | |
| 4,778,268 | A | 10/1988 | Randle | |
| 5,088,810 | A | 2/1992 | Galanter | |
| 5,757,458 | A | 5/1998 | Miller et al. | |
| 6,033,073 | A | 3/2000 | Potapova | |
| 6,155,682 | A | 12/2000 | Steinberg | |
| 2006/0082729 | A1 | 4/2006 | To et al. | |
| 2010/0103075 | A1 * | 4/2010 | Kalaboukis | A63F 13/02 345/8 |
| 2012/0062836 | A1 | 3/2012 | Tse et al. | |

OTHER PUBLICATIONS

Diether, S.; Wildsoet, C. F. , "Stimulus requirements for the decoding of myopic and hyperopic defocus under single and competing defocus conditions in the chicken." Invest Ophthalmol Vis Sci 46(7): 2242-2252 (2005).

(Continued)

*Primary Examiner* — James Greece
(74) *Attorney, Agent, or Firm* — George A. Leone; Citadel Patent Law

(57) ABSTRACT

A method for retarding or reversing progression of myopia of a viewer contains the steps of using an immersive or non-immersive device to create a plurality of image planes in the eye of the viewer. While an image plane is located on the retina, at least one image plane is not on the retina, thereby generating myopic defocus. Immersive and non-immersive devices and systems for such a method are also described.

21 Claims, 15 Drawing Sheets

(56) References Cited

OTHER PUBLICATIONS

Tse, D. Y.; to, C. H., "Graded competing regional myopic and hyperopic defocus produce summated emmetropization set points in chick." Investigative ophthalmology & visual science 52(11): 8056-8062. (2011).
Tse Y. et al., "Spatial frequency and myopic defocus detection in chick eye in a closed visual environment." ARVO, For Lauderdale.
U.S. Appl. No. 13/568,016, Notice of Restriction/Election of Claims, dated Jun. 10, 2015.
U.S. Appl. No. 13/568,016, Response to Restriction/Election of Claims, dated Jul. 31, 2015.
U.S. Appl. No. 13/568,016, Non-Final Office Action, dated Aug. 28, 2015.
U.S. Appl. No. 13/568,016, Notice of Abandonment, dated Mar. 11, 2016.
U.S. Appl. No. 15/009,224 , Non-Final Office Action, dated Feb. 8, 2017.
U.S. Appl. No. 15/009,224 , Response to Non-Final Office Action, dated May 8, 2017.
U.S. Appl. No. 15/009,224 , Examiner Initiated Interview Summary, dated Sep. 18, 2017.
U.S. Appl. No. 15/009,224 , Notice of Allowance, dated Sep. 18, 2017.

* cited by examiner

METHODS, DEVICES, AND SYSTEMS FOR INHIBITING OCULAR REFRACTIVE DISORDERS FROM PROGRESSING

TECHNICAL FIELD

The present invention relates to methods and systems for inhibiting the development or progression of refractive disorders of an eye, with the emphasis on myopia and/or hyperopia.

BACKGROUND OF THE INVENTION

Shortsightedness or myopia and farsightedness or hyperopia are common refractive disorders of human eyes. Objects beyond a distance from a myopic person are focused in front of the retina, and objects beyond a distance from a hyperopic person are focused behind the retina, and consequently the objects are perceived as blurry images.

Myopia develops when the eye grows excessively larger than the focal length of the eye. Myopia usually progresses in human eyes over time and is typically managed by regularly renewed prescriptions of optical lenses such as corrective spectacles and contact lenses. Those lenses provide clear vision but do not retard progression of myopia. Undesirable sight-threatening eye diseases are also associated with high levels of myopia.

Hyperopia is usually congenital, when the size of the eye has not grown enough and is shorter than the focal length of the eye. Without proper management, hyperopia may associate with blurred vision, amblyopia, asthenopia, accommodative dysfunction and strabismus. Hyperopia is typically managed by prescriptions of corrective optical lenses which temporarily provide clear vision but do not heal or eliminate the disorder permanently.

Therefore, there is a need for new technology to reduce the economic and social burden produced by refractive disorders such as common myopia and hyperopia by providing clear vision and a retardation function at the same time. Recent scientific publications have stated that the dimensional growth of developing eyes is modulated by optical defocus, which results when images are projected away from the retina. Refractive development of the eye is influenced by the equilibrium between defocus of opposite directions. In particular, it has been documented that artificially induced "myopic defocus" (an image projected in front of the retina) may retard myopia from progressing further. In this context, the position of "in front of the retina" refers to any position between the retina and the lens of an eye but not on the retina.

WO 2006/034652, to To, 6 Apr. 2006 suggests the use of concentric multi-zone bifocal lenses in which myopic defocus is induced both axially and peripherally for visual objects of all viewing distances. Those methods have been shown to be effective in both animal study and human clinical trial for retarding myopia progression. However, those methods comprise the prescription and the use of specialty lenses which may not be suitable for all people. Similar disadvantages apply for the other contact lens designs such as U.S. Pat. No. 7,766,478 B2, to Phillips, published Aug. 3, 2010; U.S. Pat. No. 7,832,859, to Phillips, published 16 Nov. 2010; U.S. Pat. No. 7,503,655 to Smith, et al., published 17 Mar. 2009; and U.S. Pat. No. 7,025,460 to Smith, et al., published 11 Apr. 2006.

U.S. Pat. No. 7,503,655 and U.S. Pat. No. 7,025,460, both above, suggest methods to counteract myopia by manipulating peripheral optics, inducing relative peripheral myopic defocus without inducing myopic defocus on the central retina. Since it is known that the protective effect of defocus is directly correlated with the area of retinal area exposed to it, their design may not achieve maximum effectiveness as defocus is not induced on the central retina.

Accordingly the need remains for improved methods, apparatuses, devices, and/or systems for inhibiting and potentially reducing or even curing refractive disorders of a viewer or a user. Therefore it is an objective of the current invention which make use of novel viewing systems instead of specialty lenses, to overcome or ameliorate at least one of the disadvantages of the prior art, or to provide a useful alternative.

SUMMARY OF THE INVENTION

According to the present invention, there is provided a method for retarding or reversing progression of myopia of a viewer. The viewer has an eye with a retina with a central region. The method contains the step of providing a non-immersive display unit having a display, a dioptric positive lens proximal to the display, a fully-reflective mirror opposite the dioptric positive lens from the display, and a semi-transparent mirror distal from the fully-reflective mirror. The method further contains the steps of forming a primary visual content on the display, refracting the primary visual content through the dioptric positive lens to form a primary optical channel, redirecting the primary optical channel with the fully-reflective mirror to the semi-transparent mirror, forming a secondary visual content into a secondary optical channel directed to the semi-transparent mirror, and converging the primary optical channel and the secondary optical channel into a converged optical channel. The converged optical channel forms a plurality of image planes in the eye. The image planes comprise a dioptric distance therebetween, and the dioptric distance between the plurality of image planes is the difference between the optical vergence between the primary optical channel and the secondary optical channel.

In another embodiment, there is provided a method for retarding or reversing the progression of myopia of a viewer. The viewer has an eye with a retina with a central region. The method contains the step of providing an immersive display unit having a first display, a first dioptric positive lens proximal to the first display, a first fully-reflective mirror opposite the first dioptric positive lens from the first display, a second display, a second dioptric positive lens proximal to the second display, a semi-transparent mirror opposite the second dioptric positive lens from the second display, and a second fully-reflective mirror distal from the first fully reflective mirror. The method further contains the steps of forming a primary visual content on the first display, refracting the primary visual content through the first dioptric positive lens to form a primary optical channel, redirecting the primary optical channel with the first fully-reflective mirror to the second fully-reflective mirror, forming a secondary visual content on the second display, refracting the secondary visual content though the second dioptric positive lens to form a secondary optical channel directed to the semi-transparent mirror, reflecting the secondary optical channel off of the semi-transparent mirror, converging the primary optical channel and the secondary optical channel into a converged optical channel, and reflecting the converged optical channel off of the second fully-reflective mirror. The converged optical channel forms a plurality of image planes in the eye. The image planes comprise a dioptric distance therebetween, and the dioptric distance between the plurality of image planes is the greatest difference between the plurality of image planes.

In another embodiment of the present invention, a non-immersive display unit contains a display for forming a primary visual content, a dioptric positive lens proximal to the display, a fully-reflective mirror opposite the dioptric positive lens from the display, and a semi-transparent mirror distal from the fully-reflective mirror. The primary visual content is refracted through the dioptric positive lens to form a primary optical channel, and the fully-reflective mirror redirects the primary optical channel to the semi-transparent mirror. A secondary visual content is formed into a secondary optical channel, and the secondary optical channel is directed towards the semi-transparent mirror. The semi-transparent mirror converges the primary optical channel and the secondary optical channel, into a converged optical channel, and the converged optical channel forms a plurality of image planes in the eye.

In another embodiment of the present invention, an immersive display unit contains a first display for forming a primary visual content, a first fully-reflective mirror opposite the first dioptric positive lens from the first display, a second display for forming a secondary visual content, a second dioptric positive lens proximal to the second display, a semi-transparent mirror opposite the second dioptric positive lens from the second display, and a second fully-reflective mirror distal from the first fully reflective mirror. The primary visual content is refracted through the first dioptric positive lens to form a primary optical channel, and the first fully-reflective mirror redirects the primary optical channel to the second fully-reflective mirror, refracting the secondary visual content through the second dioptric positive lens to form a secondary optic channel. The secondary optical channel is directed to the semi-transparent mirror, and the semi-transparent mirror reflects the second optical channel. The semi-transparent mirror converges the primary optical channel and the secondary optical channel into a converged optical channel, reflecting the converged optical channel off of the fully-reflective mirror. The converged optical channel forms a plurality of image planes in the eye.

BRIEF DESCRIPTION OF THE DRAWINGS

Examples of the invention will now be described with reference to the accompanying drawings, in which.

Figure 1A:
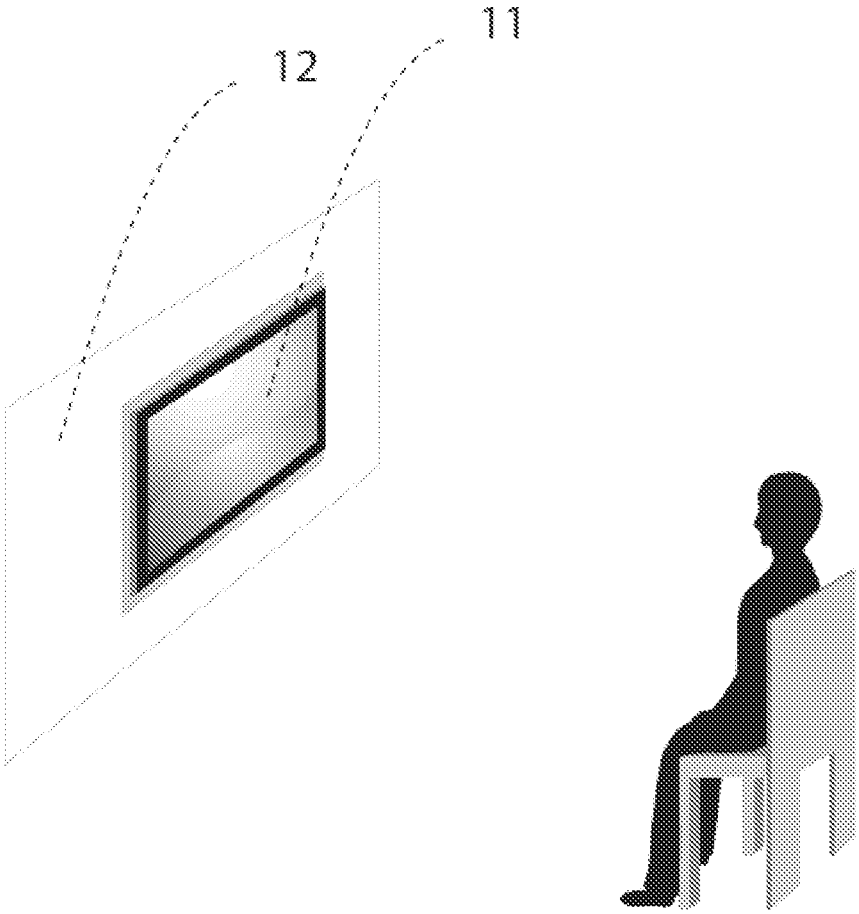
FIG. 1A is a diagram showing the way a conventional visual display unit is used.

The figures herein are not necessarily drawn to scale.

DETAILED DESCRIPTION OF THE INVENTION

One skilled in the art understands that as used herein, designations such as "first", "second", "primary,", secondary", etc. are merely provided for clarity and to indicate relative order and groupings, and are not intended to be limiting in any manner.

As used herein, the terms "viewer" and "user" are synonymous, as it is the viewer who uses the device and/or system of the present invention.

The invention relates to a method for preventing, retarding, and/or reversing progression of refractive disorders of any eye, including myopia or hyperopia of a human eye. In an embodiment herein the invention relates to a method for preventing progression of a reflective disorder. In an embodiment herein, the invention relates to a method for retarding progression of a reflective disorder. In an embodiment herein, the invention relates to a method of reversing a refractive disorder.

A method for preventing or retarding progression of myopia is provided, including producing a focused image on the retina of the human eye for viewing and simultaneously creating a defocused image in front of the retina for generating myopic defocus is described here below. Particularly, the method includes generating myopic defocus on at least the central region of the retina for achieving a treatment effect. For preventing or reducing progression of hyperopia, the method includes producing a focused image on the retina of the human eye for viewing and simultaneously creating a defocused image behind the retina for generating hyperopic defocus.

Traditional viewing systems display visual information on a single plane. When being viewed, the primary visual object such as text and graphic is focused on the retina, inducing no defocus stimuli (or small amount of myopia-inducing hyperopic defocus if the users exhibit the habit of accommodative lag). The current invention makes use of a transparent or a reflective optical layer allowing a secondary object behind or in front of the layer, respectively, to be seen simultaneously when the primary visual object is viewed. The secondary object, being positioned on different dioptric planes, is projected either in front of the retina to produce myopia-retarding myopic defocus stimuli, or behind the retina to produce hyperopia-reducing hyperopic defocus stimuli.

Transparency is commonly defined as the ability of a material to allow light to pass through itself without scattering. In this context, the transparency of the layer is a term in optical physics that describes the proportion of light transmitted through a layer which is quantifiable, adjustable and measureable between 0% to 100%. Accordingly, the meaning of the term "transparent" is not limited to the literal meaning of being totally transparent but also "partially transparent" or "being transparent or partially transparent regionally". Within the context of this disclosure, the term "transparent" with respect to a layer of material means that between about 100% and about 70%, or between about 100% and 80%, or between about 100% and about 85% of the visible light is transmitted through the layer.

Reflectance is commonly defined as the percentage of light being reflected by a surface. In this context, the meaning of the term "reflective" refers to being "light reflective". The term is not limited to the literal meaning of being totally reflective but also "partially reflective" or "being reflective or partially reflective regionally".

The transparent layer or the reflective layer as referred to in the embodiments of the present invention can be a physical screen (for the transparent or reflective layer) or a virtual imaging plane (for the transparent layer in view of the available technology) produced by various technologies including but not limited to a liquid crystal display, an organic light emitting diode, a screen projection system, a holographic display, a partial mirror, a multiscopic visualization, a volume multiplexing visualization, or a combination thereof.

The system as referred to in the embodiments of the present invention can be a permanent home, office or gymnasium visual displaying environment including components such as a desktop personal computer, a television, a theater system or a combination thereof. The system may also be a compact portable unit or an electronic device such as an electronic book reader, a tablet computer, a portable display, a portable computer, other media or a gaming system.

A number of non-limiting examples for retarding or reversing the progression of refractive disorders, with emphasis on myopia in human eyes are described herein. The apparatuses used to practice this method alter the defocus equilibrium of the eye to influence dimensional eye growth in a direction towards emmetropia. In particular, myopic defocus is induced in the eye to retard the progression of myopia. It is important that myopic defocus is introduced when normal visual tasks can be maintained throughout the treatment. This means that a focused image can be maintained at the central retina during the treatment. A transparent layer or a reflective layer in the form of a visual display unit provides a platform for projecting various kinds of primary visual content that in turn will form a focused image on the retina. At the same time, the transparency or reflectance of the layer allows secondary objects to be seen. Areas on the layer which do not provide the primary visual content may provide the transparency or the reflectance. Alternatively, the objects, including text or graphics themselves may also be partially transparent or reflective so that any other objects directly behind the transparent objects, or in front of the reflective objects, can be seen by the viewer as overlapped defocused images. Regardless of how the transparency or reflectance is provided the primary visual content on the layer (e.g. text, graphic) plays dual critical roles as the object of interest and the necessary visual clues for the viewer to lock his ocular accommodation and focus on the plane of the transparent or reflective layer. The transparent or reflective layer alone will not act as an effective target for the viewer to lock his accommodation and will not achieve the desired function unless visual content is displayed on them. According to optics principles, objects seen behind the transparent layer or in front of the reflective layer will be projected in front of the retina. Therefore, it is an effective means for simultaneously providing clear viewing and myopic defocus. Furthermore, an advantage of the system and method herein is that it does not involve the use of specialty lenses and therefore can be widely applied to children and young adults.

Figure 1B:
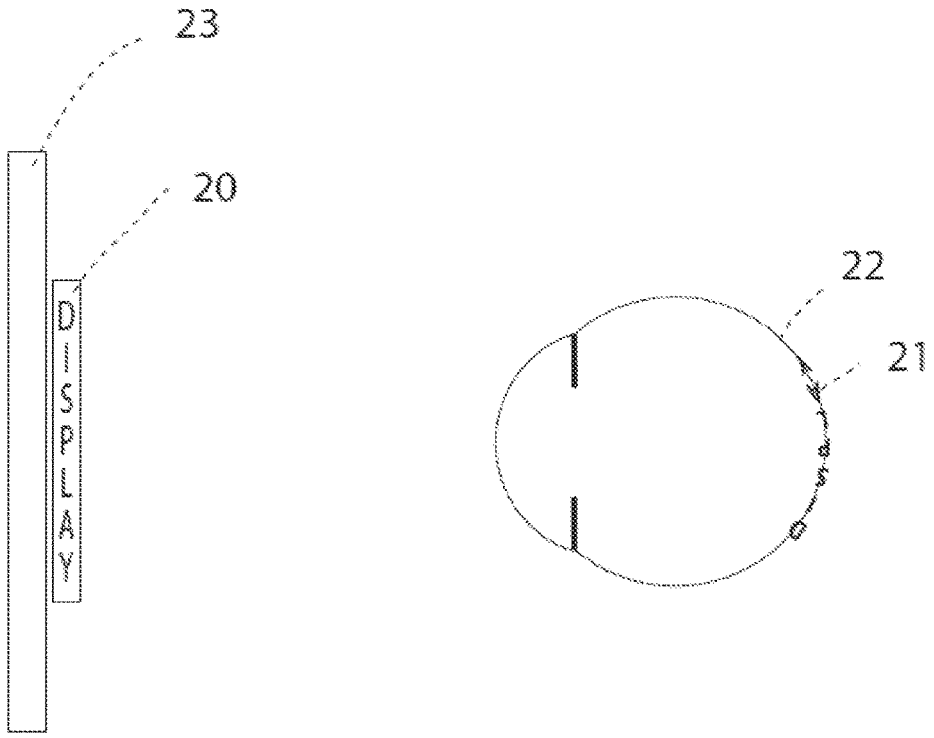
FIG. 1B is a schematic optical diagram of an eye viewing the conventional visual display unit of FIG. 1A.

FIG. 1A shows the way a conventional visual display unit is usually installed and used for viewing. The conventional visual display unit 11 does not include a transparent or reflective region in contrast to, for example, FIG. 2A at 31 or FIG. 4A at 81. Also, it may be positioned near an object 12, which is shown as a background object in the figure, which may lack significant visual details. As shown in FIG. 1B, a conventional visual display unit 20, when being viewed, produces focused image 21 on the retina 22. The object 23 behind the unit is occluded and does not provide any image on the central retina. Although the object 23 may extend toward periphery beyond the unit 20, it typically will not produce effective myopic defocus because it is located too closely to the unit 20 and/or lacks significant visual details.

Figure 2A:
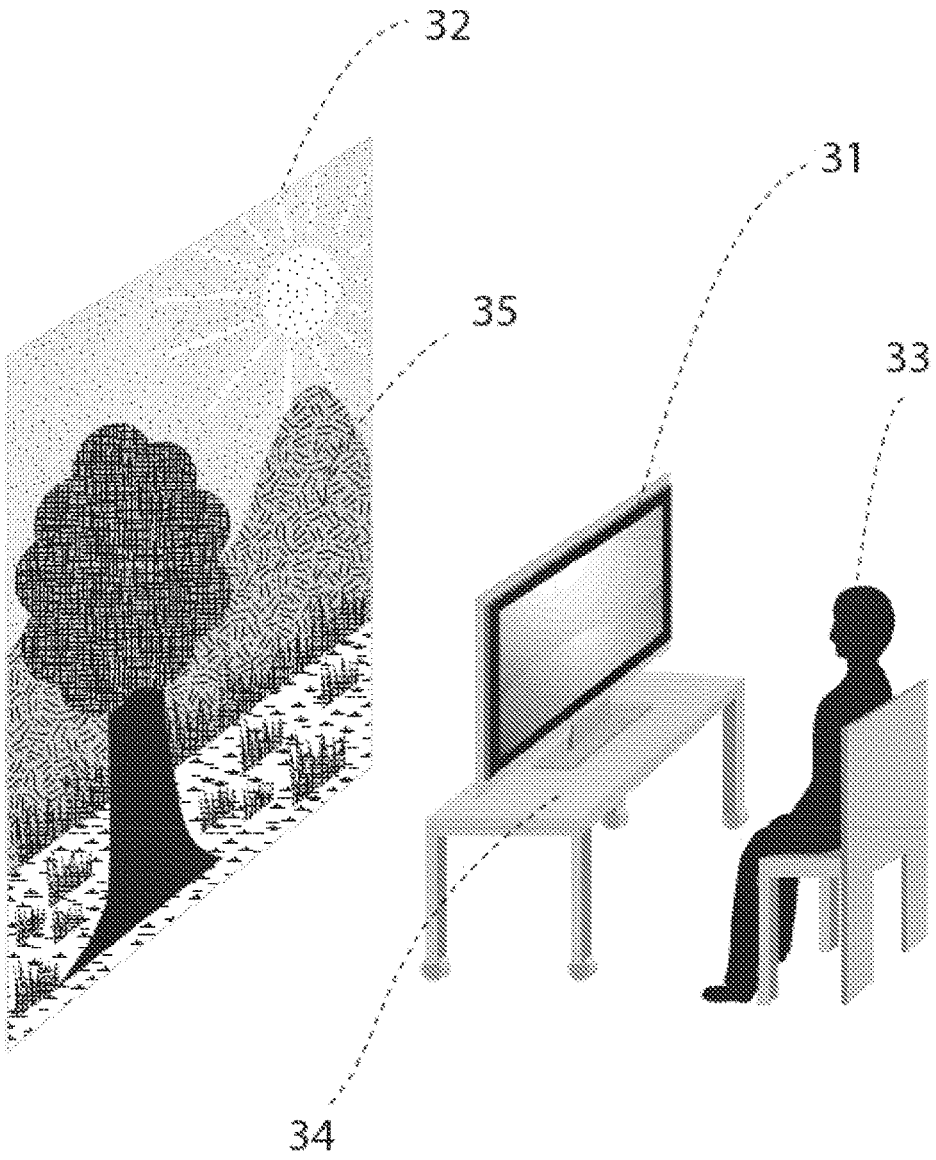
FIG. 2A is a diagram showing an optical system with a transparent layer.

In a first embodiment of the present invention, a method is provided to introduce a secondary, defocused image in front of the retina while at the same time introducing a focused image on the retina as a primary image which continuously receives attention from the viewer by means of a transparent layer. With reference to FIG. 2A, this is specifically achieved by providing an object, such as a back layer 32, in front of the viewer 33, a transparent layer 31 between the viewer 33 and the back layer 32, and subsequently a primary image on the transparent layer for the viewer's attention. The object can be either a physical object and/or an image of an object. Preferably it is some form of text or graphic on which the viewer actively adjusts his/her ocular accommodation and focus. The transparent layer 31 can be in the form of a visual display unit, such as a transparent television screen, as shown in the figure. The transparency of the transparent layer 31 allows the back layer 32 behind to be viewed as a secondary image, which is projected in front of the central region of the retina to generate myopic defocus. The object may also extend towards the periphery so that the secondary image may also project a defocused image on the peripheral retina to further boost the treatment effect. As used herein, "in front of the central region of the retina" means that the secondary image is focused on a plane at least 0.25 diopter away from the retina to the vitreous side. Preferably, the dioptric distance is from about 2 to about 3 diopters. One skilled in the art understands that this measurement of diopters is standard in the field of ophthalmology and need not be discussed in detail here. In an embodiment herein the transparency of the transparent layer is adjustable, or adjustable from about 70% to about 100% transparency, to control the amount of the secondary image to be viewed. As shown in FIG. 2A, the transparent layer 31 is positioned between the back layer 32 and the viewer 33 with the aid of some supporting structure 34. In an embodiment herein the optional supporting structure 34 is connected to the transparent layer 31 so as to physically hold it in place and to prevent it from moving significantly with respect to the back layer. Many different types of supporting structures such as a rack, a stand, a wire, an arm, and a combination thereof, may be used herein, either alone or in conjunction with each other. As used herein a supporting structure may also include a structure which suspends the transparent layer from, for example a ceiling.

In the method and methods herein, the goal is to stop progression and/or cure the eye refractive disorder by encouraging the viewer's eye to either stop growing in a certain direction, to encourage the viewer's eye to grow in another direction, and/or to grow to a certain, more optimal, shape. Thus, to increase effectiveness, the methods herein may require repeated, continuous use by the viewer for an extended period of, for example, more than 1 week; or from about 1 week to 15 years; or from about 1 month to about 10 years; or from about 2 months to about 7 years. In an embodiment herein the method herein includes the repeated viewing of the system herein over a period from about 3 months to about 5 years.

In an embodiment herein the object for producing the secondary image is a fixed or changeable wallpaper showing a landscape such as a forest or a mountain or a picture such as shown in FIG. 2A. It is preferred that such a picture contains visual content of sufficient contrast and a range of spatial frequencies, which are shown to be pre-requisites for the myopic defocus to be corrected detected by the eye. (Tse, Chan et al. 2004; Diether and Wildsoet 2005) Specifically, it is preferred that the picture contains visual content with contrast of more than 10%, or preferably from about 25% to about 75%, as measured by image capture using video camera followed by quantification of pixel brightness level. It is also preferred that the picture contains spatial frequencies ranged from 0.02-50 cycle/deg measured by image capture using video camera, followed by spatial frequency analysis using discrete Fourier transformation. The preferred optical distance between the layer on which the primary image is provided and the object to provide the secondary image is from about 0.25 to about 6 diopters, or from about 0.5 to about 4 diopters, or from about 2 to about 3 diopters. The optical distance can be measured by quantifying the power of the lens needed to neutralize the defocus, or by measuring the physical dimensions of all optical components, and followed by optical ray tracing.

In an embodiment herein the level of myopic or hyperopic defocus is specifically customized to counter the level of myopia or hyperopia of the viewer, especially, where, for example, the system is provided on, in and/or incorporating an electronic device such as a tablet computer, personal computer, smart phone, etc. that is typically used by a single person.

Figure 2B:
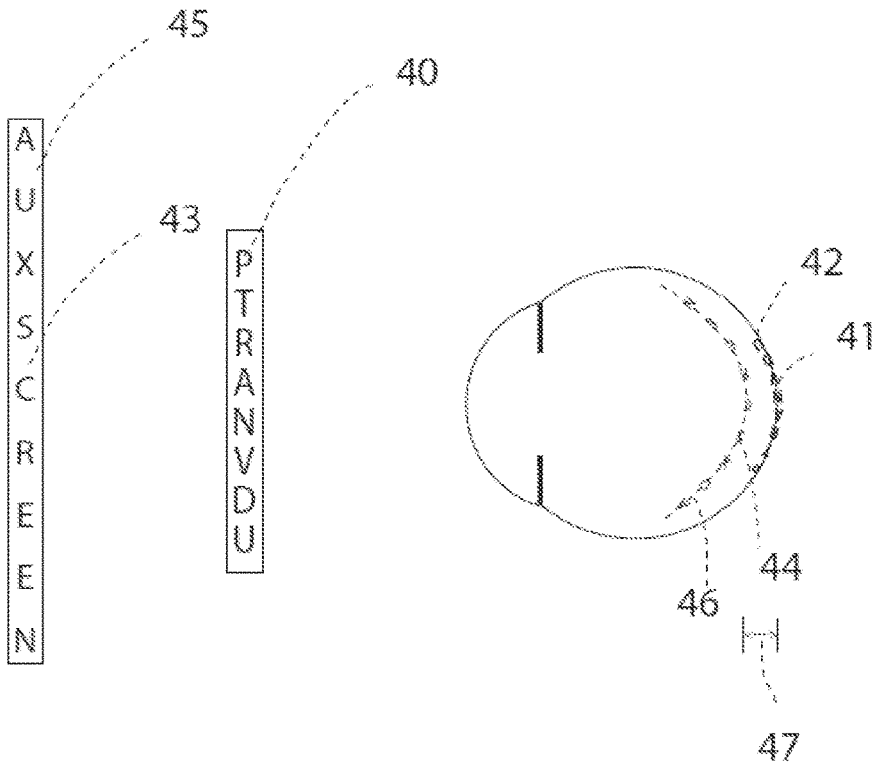
FIG. 2B is a schematic optical diagram of an eye viewing the transparent layer of the optical system of FIG. 2A showing the generated myopic defocus.

Referring to FIG. 2B, the viewer typically intentionally brings the primary image displayed by the transparent layer 40 into focus using ocular accommodation. Depending on the existing refractive error of the viewer, conventional spectacle correction may be needed (not shown in the figure) for the viewer to focus the primary image on the retina. The primary image displayed on the front layer 40 is projected in the eye as focused image 41 on the central portion of the retina 42. Simultaneously, the secondary visual content 43 of the back layer is projected in the eye as a myopically defocused secondary image 44 in front of the central region of the retina 42. The defocused secondary image 44 in front of the central retina serve as a major source of myopic defocus 47 signal for retarding myopia progression. The back layer may optionally further extend towards the periphery 45 so as to project additional myopically defocused image 46 on regions of the retina other than the central region.

The embodied optical system can be modified further, for example, it may contain a visual display unit having more than one transparent layer. The primary visual contents may be displayed on a front transparent layer as the primary image for continuous viewing by the user. Secondary visual contents which form the secondary image as the visual cues of myopic defocus, not requiring the user's attention, may be displayed on at least one back layer for constructing the defocused images.

Figure 3A:
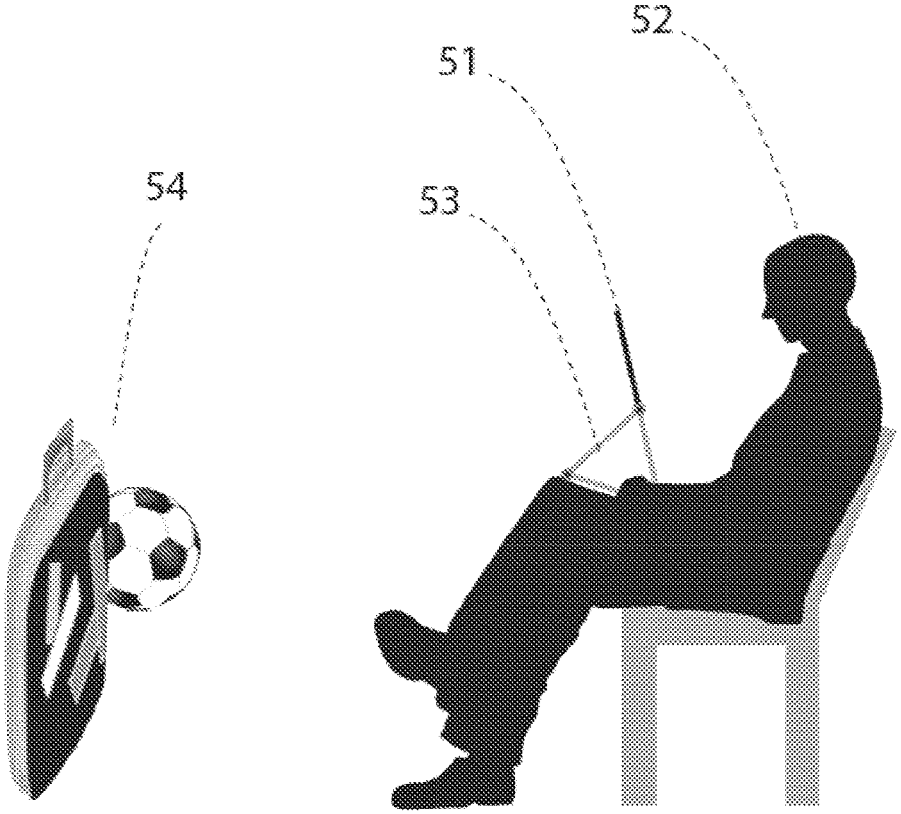
FIG. 3A is a diagram showing a portable system with the optical system of FIG. 2A.

FIG. 3A shows a simplified optical system with a single transparent layer as a visual display. The system is embodied as a compact form of a portable electronic device such as an electronic book reader unit 51. In an embodiment herein the portable electronic device herein may include an electronic book reader, a mobile phone, an electronic tablet, a computer, a personal digital assistant, a watch, a headwear, an eyewear, a wireless display, a holographic projector, a holographic screen, an augmented reality device, a virtual reality device, and a combination thereof. A transparent layer which functions as a display screen is positioned and controlled in an upright position close to the viewer 52 by means of mechanical supporting structures such as a rack 53, which becomes portable when folded. The supporting structure(s) can be connected either permanently or temporarily to the transparent layer. Random objects 54 may present in the background environment behind the unit 51. Depending on the existing refractive error of the viewer, conventional spectacle correction may be needed (not shown in the figure) for the viewer to focus the primary image on the retina.

Figure 3B:
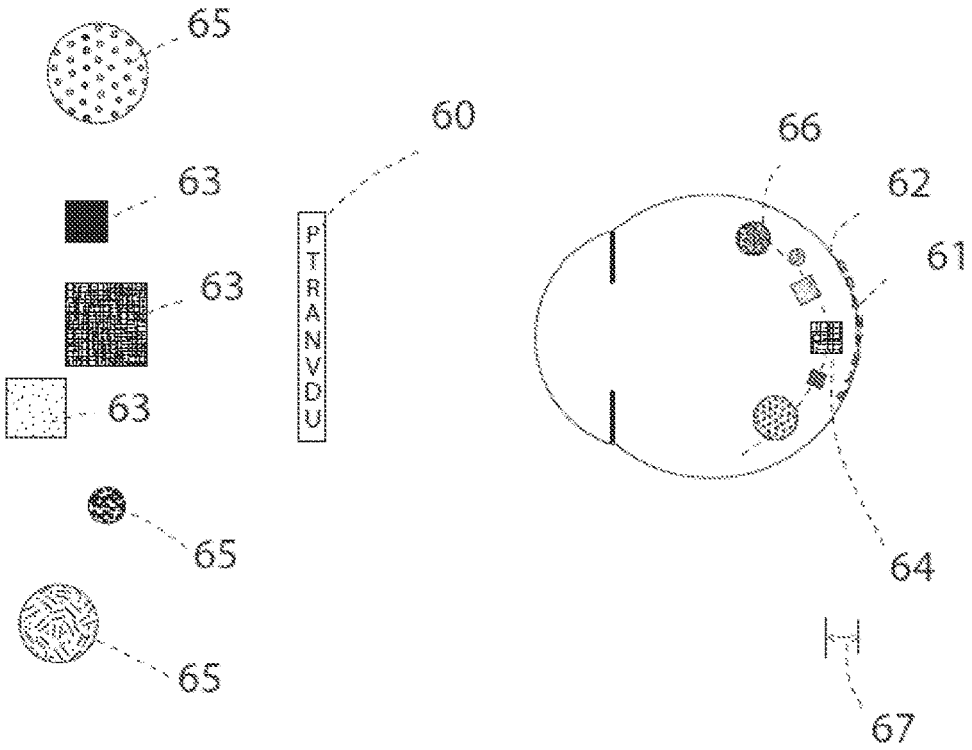
FIG. 3B is a schematic optical diagram of an eye viewing the portable system of FIG. 3A showing the generated myopic defocus.

Referring to FIG. 3B, the viewer exerts ocular accommodation to bring the primary image as displayed by the transparent layer to focus. As a result, visual content such as text and graphics as shown on the transparent layer 60 are projected on the retina 62 as a focused primary image 61. As the user carries and uses the unit in different visual environments, random visual objects 63 and 65 enter the visual field of the viewer. Objects 63 behind the transparent layer 60 are visible to the viewer as secondary images 66 and are projected to form myopically defocused images in front of the central retina 64. Those defocused secondary images serve as major sources of myopic defocus 67 signal for retarding myopia progression. Other objects 65 in the peripheral visual field that are positioned more distant from the unit can also project myopically defocused secondary images 66 on other parts of retina. Those images also serve as auxiliary sources of myopic defocus 67 for retarding myopia progression. Preferably, the transparency of the transparent layer is adjustable, either manually and/or automatically, to control the amount of background objects to be viewed.

Alternatively, in an embodiment herein, the optical system, for example, the unit 51 of FIG. 3A, can be an electronic device which generates both the primary and the secondary images on the same or different layers, for example, to provide a focused primary image and a defocused secondary image simultaneously on the same display screen.

Preferably, the transparency of the display screen of the unit 51 is adjustable and more preferably controllable, for example, by electronic means such as transparent organic light emitting diode, in order to maintain and optimize the legibility of the visual content under different environments and according to personal preference.

In another embodiment of the present invention, a method is provided to introduce myopic defocus by providing a layer having a reflective surface facing the viewer, at least one object facing the reflective surface, and subsequently a primary image with visual contents as text and graphics on the layer, with the primary image being viewable by the viewer.

Again the object can be either a physical object and/or an image of an object. The reflective surface allows the reflection of the object to be viewed by the viewer as a secondary image, and the secondary image is focused in front of the central region of the retina of the viewer. The objects can be positioned behind the viewer and/or in between the viewer and the reflective surface.

Figure 4A:
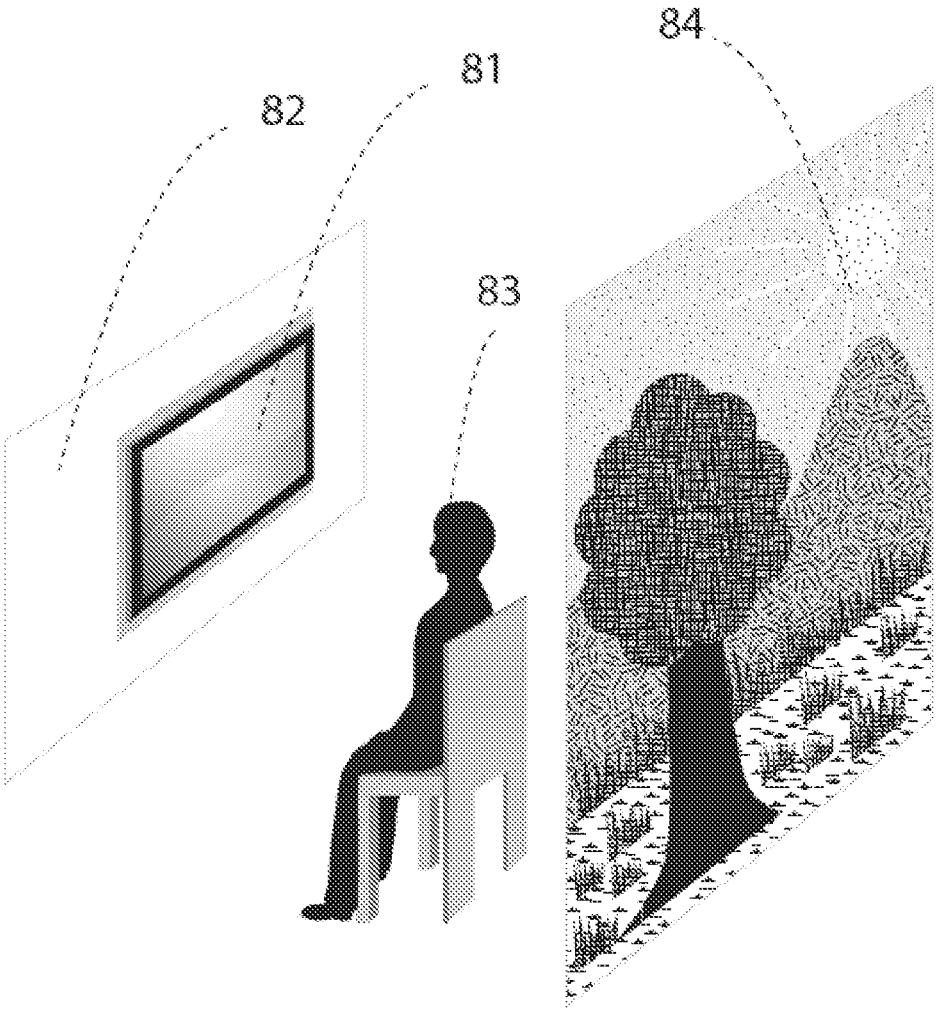
FIG. 4A is a diagram showing the way an optical system with a reflective layer.

In an embodiment herein, the reflective layer may be a visual display unit adapted to provide a primary image of a principal visual content. With reference to FIG. 4A, a method herein comprises the step of providing an object 84, such as a back layer, behind a viewer 83, and further providing a layer 81 having a reflective surface 82, such as a mirror or a display screen with reflective surface, facing the viewer 83 and the object 84. A primary image is then provided on the layer 81 for the viewer's attention. The reflectance of the reflective surface 82 allows the back layer behind the viewer to be viewed by the viewer as a reflection, and the reflection is projected in front of the retina to generate myopic defocus. The object for producing the secondary image can be fixed or changeable wallpapers behind the viewer showing landscapes such as a forest or a mountain or any pictures. It is preferred that the secondary image contains a detailed pattern having sufficient contrast and a range of spatial frequency, which is a prerequisite for the projected myopically defocused image to be detected by the retina. For example, a projected landscape photo or wallpaper 84 is used in the system in FIG. 4A.

Figure 4B:
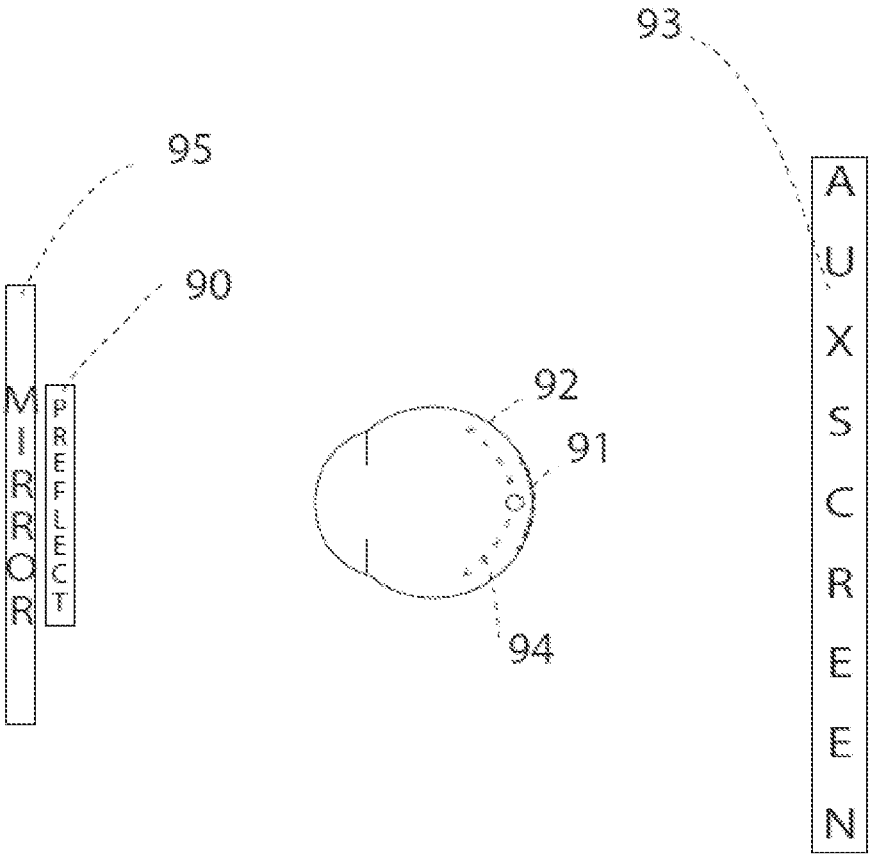
FIG. 4B is a schematic optical diagram of an eye viewing the optical system of FIG. 4A showing the generated myopic defocus.

With reference to FIG. 4B, the viewer intentionally brings the primary image displayed by the layer 90 into focus using ocular accommodation. Depending on the existing refractive error of the viewer, conventional spectacle correction may be needed (not shown in the figure) for the viewer to correctly focus the primary image on the retina. The primary image displayed on the front layer 90 is projected in the eye as focused image 91 on the central region of the retina 92. Simultaneously, the object 93 behind the viewer providing the visual content is reflected by the mirror 95 and is projected in the eye as a myopically defocused secondary image 94 in front of the central region of the retina 92. The defocused secondary image 94 in front of the central retina serves as a major source of myopic defocus signal for retarding myopia progression. The object 93 may optionally further extend towards the periphery so as to project additional myopically defocused image on the peripheral retina to further boost the treatment effect.

Preferably, the light reflectance of the reflective surface is adjustable so as to control the clarity or legibility of the primary object to be viewed. As shown in FIG. 4A, the layer 81 is facing the viewer 83 and the back layer 84 by mounting onto the wall. Alternatively, the layer 81 can be connected to or supported by a supporting structure. Many different supporting structures such as a rack, a stand, a wire, an arm, and a combination thereof, may be used herein, either alone or in conjunction with each other. As used herein a supporting structure may also include a structure which suspends the layer.

The optical system as embodied above can be further modified. For example, it may contain a visual display unit having more than one layer. The primary visual contents are displayed on a front layer as the primary image for viewing continuously by the user. Secondary visual contents which form the secondary image as the visual cues of myopic defocus, not requiring the user's attention, are displayed on at least one back layer for constructing defocus images.

Figure 5A:
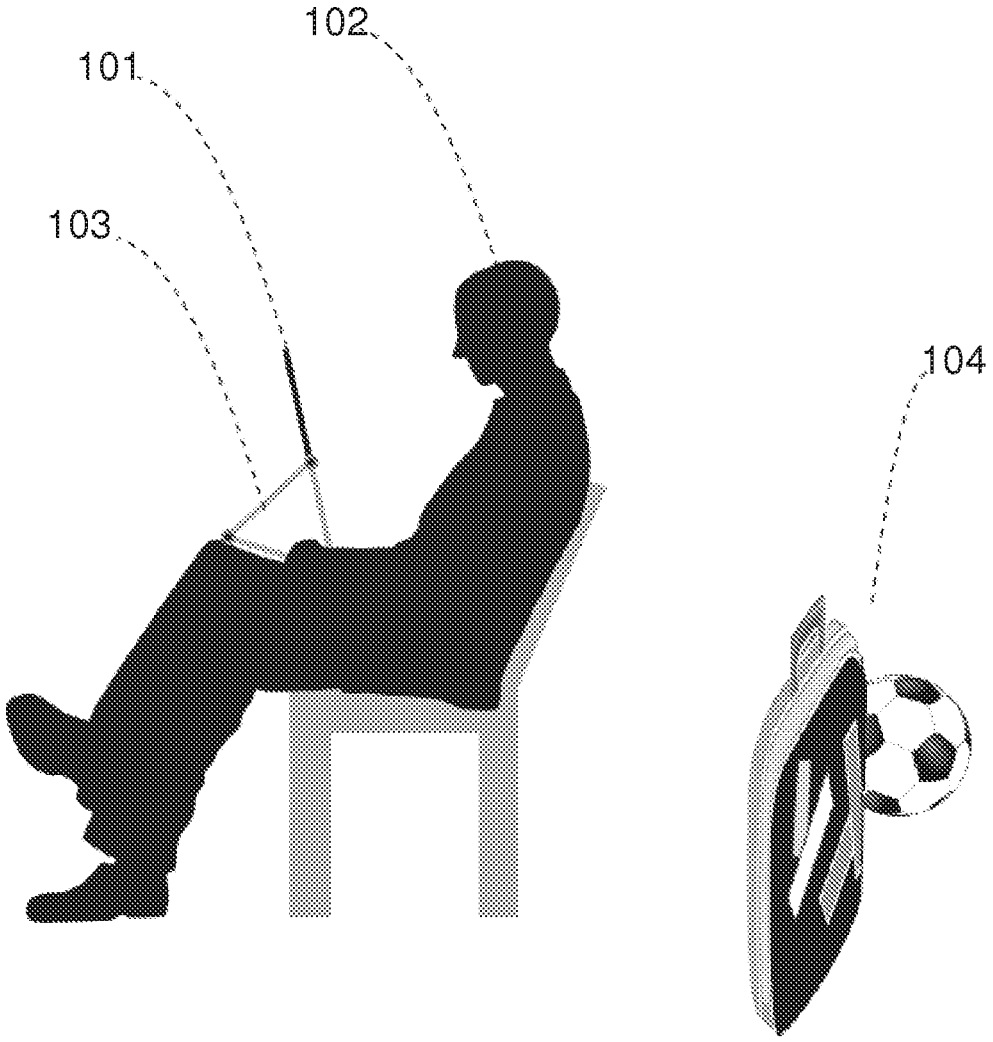
FIG. 5A is a diagram showing a portable system with the optical system of FIG. 4A.
Figure 5B:
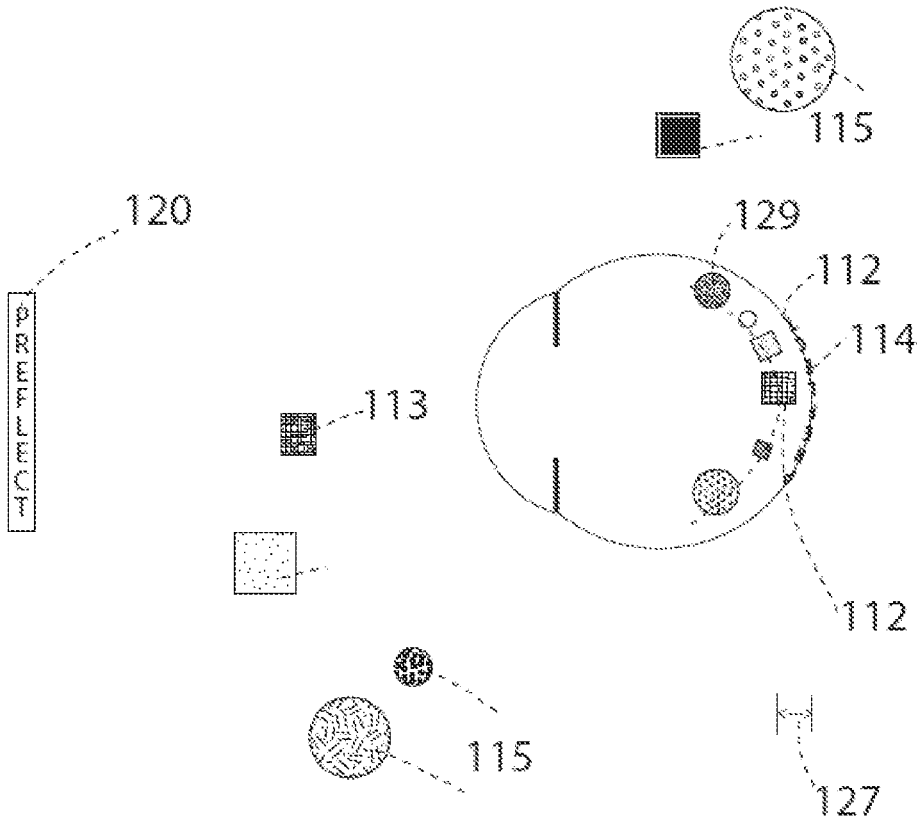
FIG. 5B is a schematic optical diagram of an eye viewing the portable system of FIG. 5A showing the generated myopic defocus.

FIG. 5A shows a simplified optical system with a single reflective layer as a visual display. The system is embodied as a compact form of a portable electronic device such as an electronic book reader unit 101. The layer which functions as a display screen is connected to and is positioned in an upright position close to the viewer 102 by means of mechanical supporting structures such as a rack 103, which may become portable when folded. Random objects 104 may present anywhere in front of the unit 101. Depending on the existing refractive error of the viewer, conventional spectacle correction may be needed (not shown in the figure) for the viewer to focus the primary image on the retina. Referring to FIG. 5B, the viewer exerts ocular accommodation to bring the primary image as displayed by the layer to focus. As a result, visual content such as text and graphics as shown on the unit are projected on the retina 112 as a focused primary image 114. As the user carries and uses the unit in different visual environments, random secondary visual objects 113 and 115 enter the visual field of the viewer. Objects 113 facing the reflective surface of the layer 120 are visible to the viewer as secondary images 122 and are projected to form myopically defocused images in front of the central retina. Those defocused secondary images serve as major sources of myopic defocus 127 signal for retarding myopia progression. Other objects 115 in the peripheral visual field that are positioned more distant from the unit can also project myopically defocused secondary images 129 on other parts of retina. Those images serve as auxiliary sources of myopic defocus 127 for retarding myopia progression.

Preferably, the light reflectance of the reflective surface of the unit 101 is adjustable and more preferably controllable, for example, by electronic means such as the top emitting OLED technology, in order to maintain and optimize the legibility of the visual content under different environments and personal preference.

Figure 6:
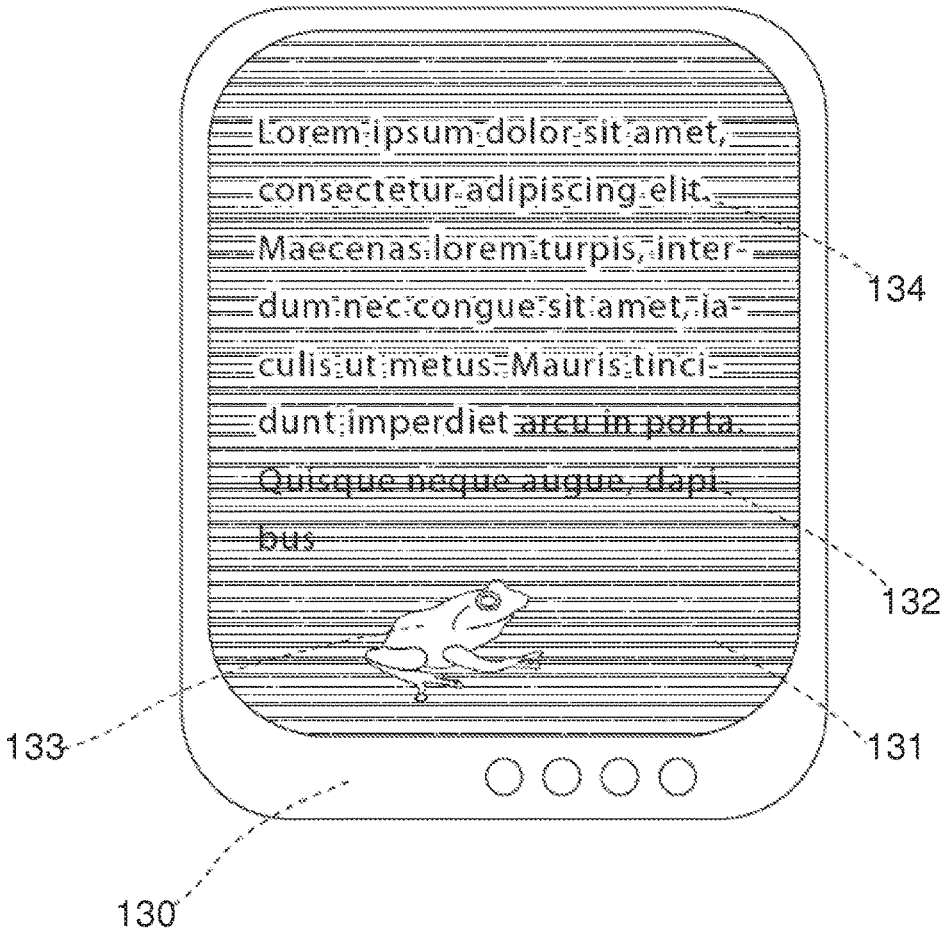
FIG. 6 is a diagram of a portable visual display unit employing a transparent layer or a reflective layer, and a contrast enhancing technology. The shade represents the transparent layer or the reflective layer.

FIG. 6 describes an example of electronic book reader unit 130 employing a transparent or reflective displaying layer as embodied in the present invention. The unit 130 uses a contrast enhancement technology to prevent the displayed text or graphic from losing legibility due to the confusion from the defocused images of the objects behind the layer. For example, in one embodiment, an organic light emitting diode display can be used to display the primary image. Idle area 131 of the layer without text 132 or graphic 133 remains transparent or reflective (as depicted by the line-shaded areas in the figure). The displayed texts or graphics are deliberately surrounded by edges 134 of a contrasting color relative to the color of the texts or graphics to enhance contrast. For example, white text may be surrounded by black edge, or blue text may be surrounded by yellow edge, etc. In an embodiment herein the primary image (herein including text), contains at least one edge, and the edge is surrounded by a contrasting color.

The capability of the current invention to treat myopia and hyperopia is supported by the applicants' previous study using an animal model (Tse and To 2011), which showed that myopic defocus and hyperopic defocus may be introduced to the eye using a dual-layer viewing system. In that study, the front layer of the dual-layer system was made to become partially transparent so that the back layer can be seen. When properly controlled, the back layer may produce myopic defocus while the front layer may produce hyperopic defocus. It was shown that the refractive error of the eye was modulated by the amount of myopic defocus, hyperopic defocus or (more precisely) that the ratio between them produced by the dual-layer system in a controllable manner. Therefore, it appears feasible that similar multi-layer viewing systems may be applied to treat human refractive error through the use of a transparent layer or its variant as reflective layer.

Figure 7:
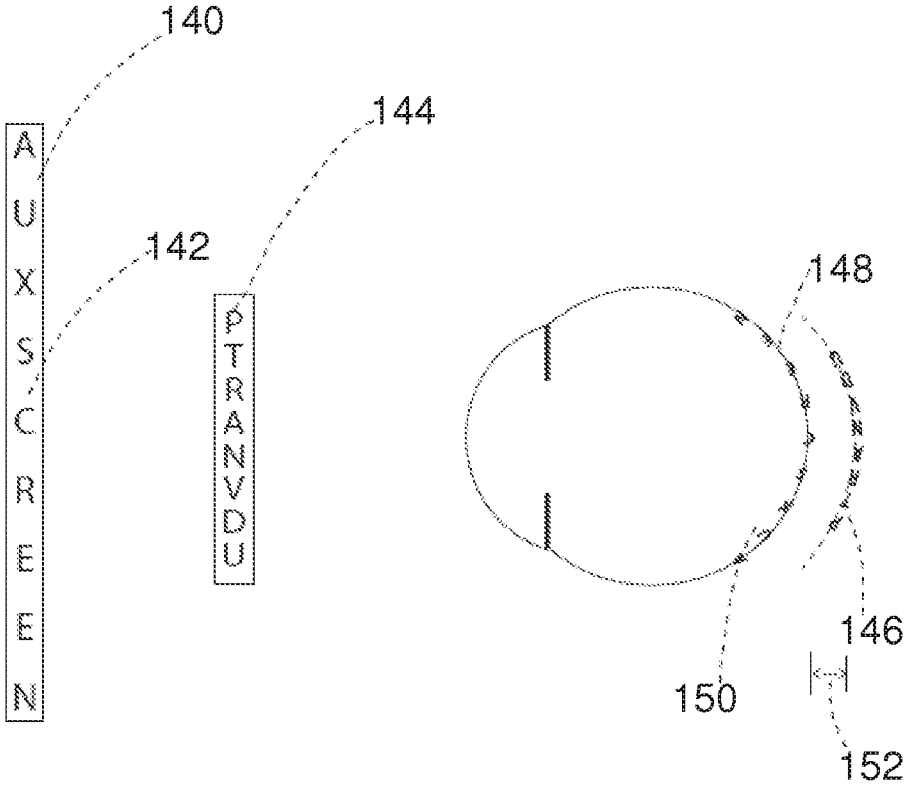
FIG. 7 is a schematic optical diagram of an eye viewing the optical system of FIG. 2A showing the generated hyperopic defocus.

FIG. 7 shows a further embodiment of the present invention which relates to an optical system for treating hyperopia. Primary visual contents 142 are displayed by the back layer 140 for viewing, while secondary visual contents which do not require attention from the viewer are displayed by the front transparent layer 144. When the user consciously focuses on the back layer 140 using ocular accommodation, the image of the primary visual contents displayed on the back layer 140 are projected in the eye as focused primary image 148. Secondary visual content on the front transparent layer 144 are projected in the eye behind the retina 150 as hyperopically defocused secondary image(s) 146. The defocused image serves as a major source of hyperopic defocus 152 stimuli for accelerating eye growth and reducing hyperopia.

Figure 8:
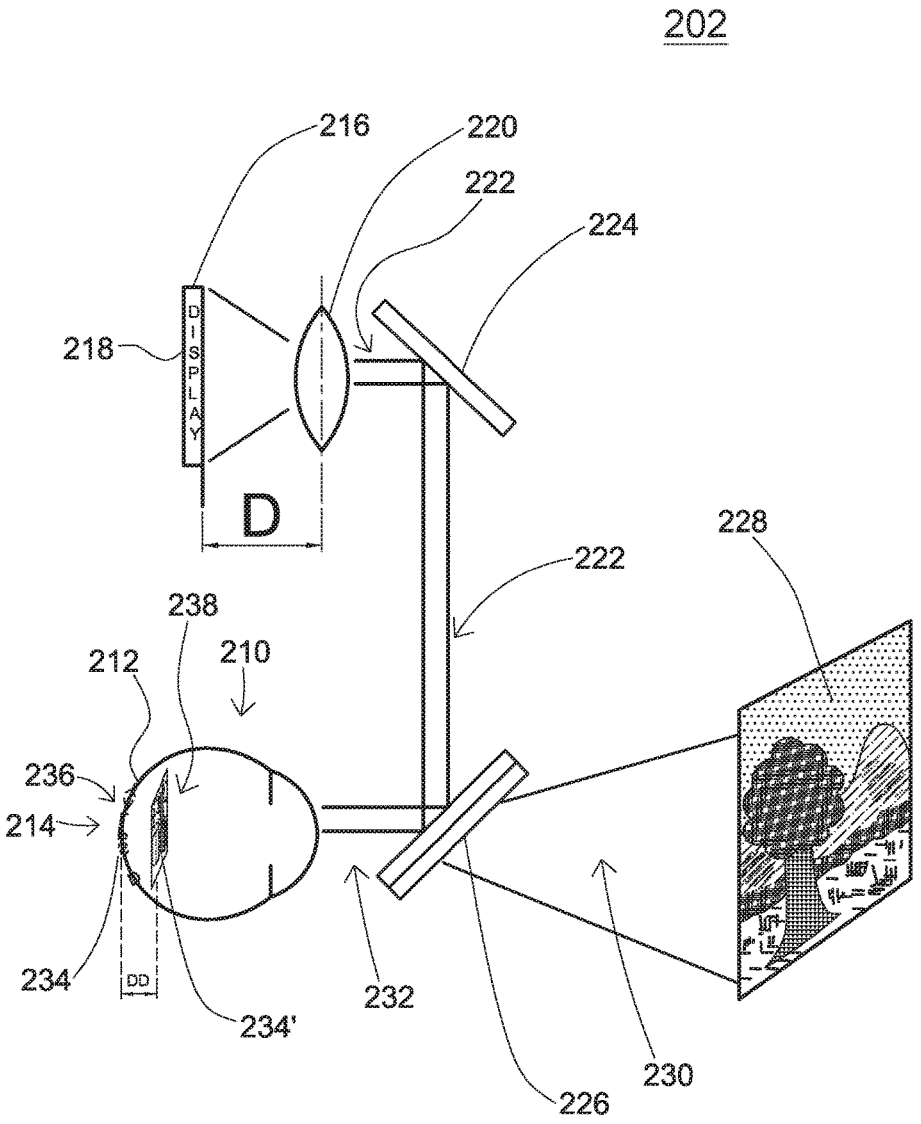
FIG. 8 is a schematic optical diagram of an embodiment of a non-immersive display unit of the present invention.

FIG. 8 is a schematic optical diagram of an embodiment of a non-immersive display unit, 202, of the present invention, useful, for example in an augmented reality embodiment. In FIG. 8, a viewer's eye, 210, contains a retina, 212, with a central region, 214. A display, 216, is provided which forms a primary visual content, 218, on the display, 216. In this embodiment, the primary visual content, 218, is of the primary interest to the user/viewer. A dioptric positive lens, 220, is provided proximal to the display, 216, and refracts the primary visual content, 218, through the dioptric lens, 220, to form a primary optical channel, 222.

A fully-reflective mirror, 224, is located opposite the dioptric positive lens, 220, from the display, 216. The fully-reflective mirror, 224, redirects the primary optical channel, 222, towards a semi-transparent mirror, 226. The semi-transparent mirror, 226, is distal from the fully-reflective mirror, 224. In an embodiment herein, the semi-transparent mirror is a pellicle mirror, a beam splitter, with or without a polarizer, and a combination thereof.

In an embodiment herein, the semi-transparent mirror is adjustable; or adjustable to vary the ratio between reflectance and transparence; or is electrochromic, and/or a combination thereof. Adjusting the semi-transparent mirror's reflectance; or the ratio between reflectance and transparence, allows the user to vary the relative intensities of the primary visual content and the secondary visual content, as seen by the eye. Without intending to be limited by theory, it is believed that such an adjustable feature may especially be useful in a case where, for example, an augmented reality embodiment needs to adjust for indoor/outdoor situations, bright/dim light situations, etc.

In FIG. 8, a second visual content, 228, which in this case is from an object that is distal to the viewer, is formed into a secondary optical channel, 230, and is directed to the semi-transparent mirror, 226. The primary optical channel, 222 and the secondary optical channel, 230, are converged by the semi-transparent mirror, 226, into a converged optical channel, 232, which contains the optical information for both the primary optical channel, 222, and the secondary optical channel, 230.

Figure 9:
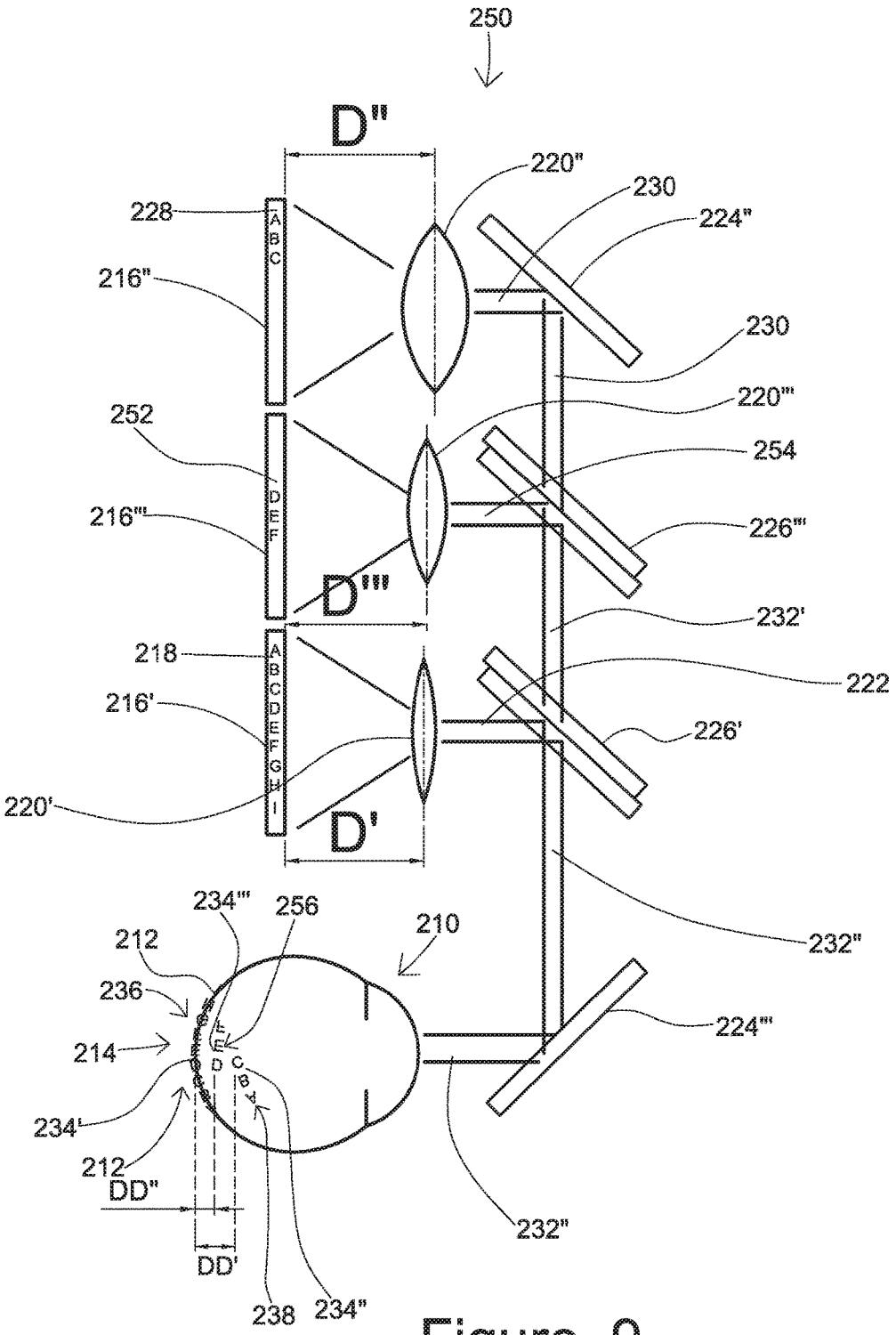
FIG. 9 is a schematic optical diagram of an embodiment of an immersive display unit of the present invention.

Upon entering the eye, 210, the converged optical channel, 232, of FIG. 8 forms a plurality of image planes, 234, in the eye. Here a primary image plane, 234', and a secondary image plane, 234" (as shown in FIG. 9), are formed. One skilled in the art understands that the primary image plane, 234', contains a primary image, 236, which is directly-influenced by the primary visual content, 218, and is upside-down. Similarly, a secondary image, 238, is located on the secondary image plane, 234" (see FIG. 9), and that the secondary image, 238, is directly influenced by the secondary visual content, 228, and is upside-down. Further, in FIG. 8, the primary image, 236, is focused on the retina, 212.

A dioptric distance, DD, exists between the image planes, 234', and 234", and is determined by the optical variance between the primary optical channel, 222, and the secondary optical channel, 230.

One skilled in the art understands that the dioptric distance, DD, may be adjusted by, for example, adjusting the distance, D, between the display, 216, and the dioptric positive lens, 220, by adjusting the power of the dioptric lens, 220, itself, etc.

In the embodiment of FIG. 8, the dioptric positive lens, 216, is a high dioptric power positive lens of, for example, +30 D. The distance, D, is 3 cm and the dioptric positive lens, 220, forms a primary optical channel, 222, of −3 D negative optical vergence. In the embodiment of FIG. 8, the dioptric distance between the two image planes, 234, specifically the primary image plane, 234' and the secondary image plane, 234", is about 3 D, which is the difference between the optical vergence of the primary optical channel, 222, and the secondary optical channel, 230.

In an embodiment herein, the dioptric positive lens has a baseline power of from about 10 D to about 100 D; or from about 25 D to about 35 D. In an embodiment herein, the dioptric positive lens is adjustable (relative to the baseline power) from about +6 D to about −6 D; or from about +3 D to about −3 D.

The plurality of image planes from the embodiment herein, generates myopic defocus in the eye of the viewer so as to retard or reverse the progression of myopia. Thus, in an embodiment herein, the method further includes the step of generating myopic defocus.

In an embodiment herein, a controller (see FIG. 10 at 282); or software in the controller (see FIG. 10 at 282), monitors the system herein so that the attention of the user's eye, 210, is drawn to the primary visual content, 218, and therefore the primary image, 236.

The controller (see FIG. 10 at 282) tracks and controls the primary visual content, 218, and the primary image, 236, so that the user naturally adjusts his/her accommodation to focus the primary image, 236, on the retina, 212. The controller (see FIG. 10 at 282) then ensures that the secondary visual content, 228, etc. are focused as the secondary image, 238, etc., respectively, having different dioptric vergence are then focused in front of the retina, at the image plane, 234', etc. This in turn creates myopic defocus.

In an embodiment herein, the level of myopic defocus, ocular accommodation, and a combination thereof is customized for the user; or the eye. In an embodiment herein, the non-immersive display unit is customized for a specific user's eye. In an embodiment herein, a pair of non-immersive display units are provided with the same or different specifications, so as to simultaneously retard or reverse the progression of myopia in two eyes of the same user.

In an embodiment herein, the non-immersive display unit herein comprises eyeglasses. In an embodiment herein, a pair of eyeglasses comprises the non-immersive display unit herein.

FIG. 9 is a schematic optical diagram of an embodiment of an immersive display unit, 250, of the present invention, such as may be useful in, for example, a virtual reality headset or glasses. In this embodiment, a viewer's eye, 210, contains a retina, 212, with a central area, 214. A first display, 216', is provided which forms a primary visual content, 218, which is of primary interest to the user/viewer. A dioptric positive lens, 220', here a high dioptric positive lens, is provided proximal to the first display, 216'. The dioptric positive lens, 220', is placed a distance, D', from the first display, 216', and refracts the primary visual content, 218, to form a primary optical channel, 222.

A second display, 216", is provided which forms a secondary visual content, 228, which is not of primary interest to the user/viewer. A dioptric positive lens, 220", herein a high dioptric positive lens, is provided proximal to the second display, 216". The dioptric positive lens, 220", is placed a distance, D", from the second display, 216", and refracts the secondary visual content, 228, to form a secondary optical channel, 230.

A third display, 216'", is provided which forms a tertiary visual content, 252, which is not of primary interest to the user/viewer. A dioptric positive lens, 220'", herein a high dioptric positive lens, is provided proximal to the third display, 216'". The dioptric positive lens, 220'", is placed a distance, D", from the third display, 216", and refracts the tertiary visual content, 252, to form a tertiary optical channel, 254.

In the embodiment of FIG. 9, the primary optical channel, 222, the secondary optical channel, 230, and the tertiary optical channel, 254, are converged by the system formed by a semi-transparent mirror, 226', a fully-reflective mirror, 224", and a semi-transparent mirror, 226'", respectively. Specifically, the fully-reflective mirror, 224", reflects the secondary optical channel, 230, towards the semi-transparent mirror, 226". The semi-transparent mirror, 216', and a fully-reflective mirror, 224". The semi-transparent mirror, 226'", reflects the tertiary optical channel, 254, and converges the secondary optical channel, 230, and the tertiary optical channel, 254, into a converged optical channel, 232', which is in turn targeted towards the semi-transparent mirror, 226'. The converged optical channel, 232', contains the visual information of the secondary optical channel, 230, and the tertiary optical channel, 254. The semi-transparent mirror, 226', reflects the primary optical channel, 222, and converges the primary optical channel, 222, and the converged optical channel, 232', which becomes the converged optical channel, 232". The converged optical channel, 232", contains the visual information of the primary optical channel, 222, the secondary optical channel, 230, and the tertiary optical channel, 254. The converged optical channel 232", is in turn targeted towards the fully-reflective mirror, 224".

The fully-reflective mirror, 224'", reflects the converged optical channel, 232", into the eye, 210. Upon entering the eye, 210, the converged optical channel, 232", of FIG. 9 forms a plurality of image planes, specifically, a primary image plane, 234', a secondary image plane, 234", and a tertiary image plane, 234'", are formed in the eye. One skilled in the art understands that the primary image plane, 234', contains a primary image, 236, which is directly-influenced by the primary visual content, 218, and is upside-down. Similarly, a secondary image, 238, is located on the secondary image plane, 234". The secondary image, 238, is directly influenced by the secondary visual content, 228, and is upside-down. Finally, a tertiary image, 256, is located on the tertiary image plane, 234'", and the tertiary image, 256, is directly influenced by the tertiary visual content, 252, and is also upside-down. Further, in FIG. 9, the primary image, 236, is focused on the retina, 212, while the secondary image, 238, and the tertiary image, 256, are focused in front of the retina, 212.

Generally, a dioptric distance, DD', DD", etc. exists between the image planes, 234', 234", and 234'", and is determined by the optical variance between the primary optical channel, 222, the secondary optical channel, 230, and/or the primary optical channel, 222, and the tertiary optical channel, 254, whichever is greater. More specifically, the dioptric distance, DD', is related to the difference in optical vergence between the primary optical channel, 222, and the secondary optical channel, 230. Similarly, dioptric distance, DD", is related to the difference in optical vergence between the primary optical channel, 222, and the tertiary optical channel, 254.

In the embodiment of FIG. 9, regarding the primary visual content, 218, the dioptric positive lens, 220', is +29 D, and is positioned a distance, D', of 3 cm from the first display, 216'. The dioptric positive lens, 220', refracts the primary visual content, 218, into rays forming the primary optical channel, 222, having a negative optical vergence of −4 D. Regarding the secondary visual content, 228, the dioptric positive lens, 220", is +30.5 D, and is positioned a distance, D", of 3 cm from the second display, 216". The dioptric positive lens, 220", refracts the secondary visual content, 228, into rays forming the secondary optical channel, 222", having a negative optical vergence of −2.5 D. Regarding the tertiary visual content, 252, the dioptric positive lens, 220'", is +32 D, and is positioned a distance, D'", of 3 cm from the third display, 216'". The dioptric positive lens, 220'", refracts the tertiary visual content, 252, into rays forming the tertiary optical channel, 254, having a negative optical vergence of −1 D.

Without intending to be limited by theory, it is believed that the primary visual content, 218, presented on the display, 216', is imaged on the retina, 212, of the eye, 210, as the primary image, 236, and as this image is of primary interest to the user, induces and determine the amount of ocular accommodation. Simultaneously, the secondary visual content, 228, and the tertiary visual content, 252, are projected in the eye, 210, in front of the retina, 212, as myopically defocused images, specifically, the secondary image, 238, and tertiary image, 256, respectively. The secondary image and the tertiary image generate myopic defocus, which it is believed may retard, or even reverse the progression of myopia.

In an embodiment herein, the relative intensity of a myopically-defocused image to the primary image is controlled by an adjustable semi-transparent mirror.

In an embodiment herein, the present invention provides for and/or generates a plurality of myopically-defocused images in the eye.

In an embodiment herein, the optical vergence of any of the optical channels, for example as see in FIGS. 8 and 9, can be fine-tuned by, for example, adjusting the distances, D, the power of the lenses, etc.

In an embodiment herein, the various mirrors, displays, lenses, etc. in the immersive display unit are arranged in 3 dimensions, may contain a plurality of optical channels, etc. and therefore do not necessarily need to be in the specific arrangement described in FIG. 9.

Figure 10:
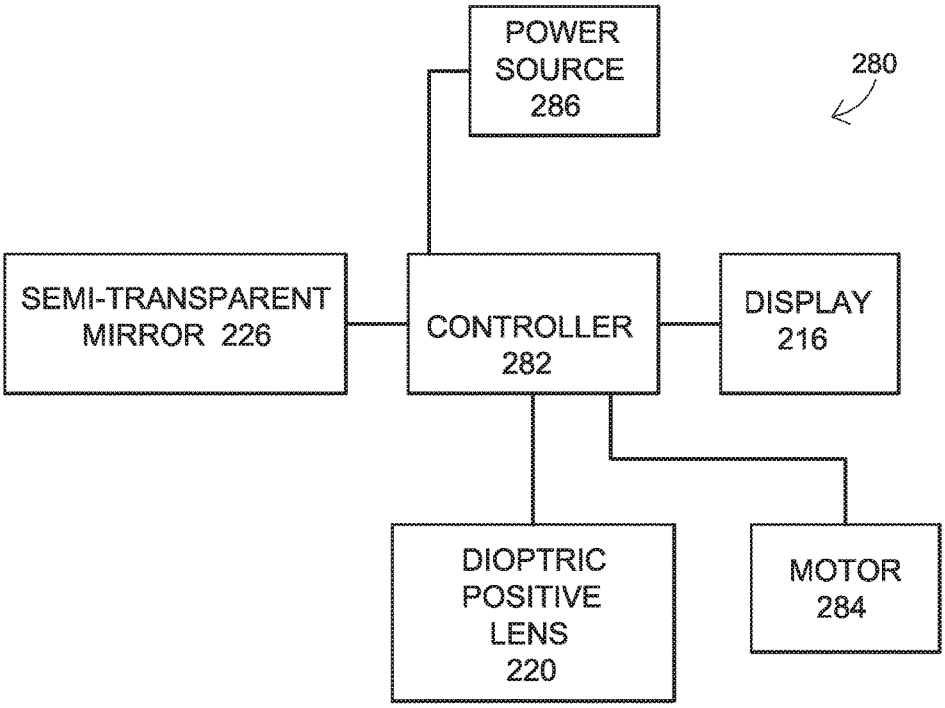
FIG. 10 is a schematic diagram of an embodiment of an electronic control system useful herein.

FIG. 10 is a schematic diagram of an embodiment of an electronic control system, 280, useful herein. A controller, 282, is electronically-connected to a semi-transparent mirror, 226, a display, 216, a dioptric positive lens, 220, a motor, 284, and a combination thereof, if multiple semi-transparent mirrors, displays, and/or dioptric positive lenses are present. The controller typically is, or contains, a microchip and/or software which controls one or more factors such as, for example, the transparency to reflectance ratio of the semi-transparent mirror, especially if it is a electrochromic pellicle mirror, the power of the dioptric positive lens, the distance between the dioptric positive lens and the display, the distance between the mirror and the semi-transparent mirror(s), the image(s) on the display(s), the intensity of the display, the semi-transparent mirror, the orientation of the polarizer, the intensity of the polarizer, etc.

In an embodiment herein, the non-immersive display unit is operatively-connected to a player for, contains, and/or is used for viewing entertainment selected from the group consisting of a movie, a game, a video, a show, a broadcast, a streaming video, a picture, and a combination thereof; or a video, a game, and a combination thereof; or a video game.

In FIG. 10, the controller is also connected to a power source, 286, which may be, for example, an electric power source; or a battery, a power outlet, a generator, and a combination thereof.

One skilled in the art understands that for the sake of brevity, the Applicant used the term "myopia" and its variations such as "myopic" herein. Furthermore, for the sake of brevity, the Applicant used the term "dioptric positive lens" herein. However, one skilled in the art also understands that the present invention would be at least equally applicable to a viewer; or a user, or an eye, having hyperopia/a hyperoptic condition, and that in such cases dioptric negative lenses would also be useful herein. Furthermore, the Applicant believes that a comparable device for treating and/or method of treatment for hyperopia is also clearly within the scope of the present invention, and that embodiments of the invention described herein may be easily adaptable by one skilled in the art to treat, for example, hyperopia.

The description, figures, examples, etc. herein are for the facilitation of understanding and are not to be construed as limiting in any way upon the scope of the invention. It is expected that one skilled in the art will be able to envision other embodiments of the invention based on a full and complete reading of the specification and the appended claims. All relevant parts of all references cited or described herein are incorporated by reference herein. The incorporation of any reference is not in any way to be construed as an admission that the reference is available as prior art with respect to the present invention.

REFERENCES

Diether, S. and C. F. Wildsoet (2005). "Stimulus requirements for the decoding of myopic and hyperopic defocus under single and competing defocus conditions in the chicken." *Invest Ophthalmol Vis Sci* 46(7): 2242-2252.

Tse, D. Y. and C. H. To (2011). "Graded competing regional myopic and hyperopic defocus produce summated emmetropization set points in chick." *Investigative ophthalmology & visual science* 52(11): 8056-8062.

Tse, Y., J. Chan, et al. (2004). *Spatial frequency and myopic defocus detection in chick eye in a closed visual environment*. ARVO, Fort Lauderdale.

We claim:

1. A method for retarding or reversing the progression of myopia of a viewer, the viewer having an eye with a retina with a central region, the method comprising the steps of:

A) providing a non-immersive display unit comprising:
- i) a display;
- ii) a dioptric positive lens proximal to the display;
- iii) a fully-reflective mirror opposite the dioptric positive lens from the display; and
- iv) a semi-transparent mirror distal from the fully-reflective mirror;

B) forming a primary visual content on the display;

C) refracting the primary visual content through the dioptric positive lens to form a primary optical channel;

D) redirecting the primary optical channel with the fully-reflective mirror to the semi-transparent mirror;

E) forming a secondary visual content into a secondary optical channel directed to the semi-transparent mirror; and F) converging the primary optical channel and the secondary optical channel into a converged optical channel, wherein the converged optical channel forms a plurality of image planes in the eye, wherein the image planes comprise a dioptric distance therebetween, and wherein the dioptric distance between the plurality of image planes is the difference between the optical vergence between the primary optical channel and the secondary optical channel.

2. The method for retarding or reversing the progression of myopia of a viewer according to claim 1, wherein the semi-transparent mirror is a pellicle mirror.

3. The method for retarding or reversing the progression of myopia of a viewer according to claim 1, wherein the dioptric positive lens has a baseline power from about 10 D to about 100 D.

4. The method for retarding or reversing the progression of myopia of a viewer according to claim 1, wherein the plurality of image planes generates myopic defocus.

5. The method for retarding or reversing the progression of myopia of a viewer according to claim 1, further comprising the step of: generating myopic defocus.

6. The method for retarding or reversing the progression of myopia of a viewer according to claim 1, wherein the plurality of image planes comprises a primary image plane comprising a primary image and a secondary image plane comprising a secondary image, and wherein the primary image is focused on the retina.

7. The method for retarding or reversing the progression of myopia of a viewer according to claim 1, wherein the semi-transparent mirror comprises an adjustable reflectance.

8. The method for retarding or reversing the progression of myopia of a viewer according to claim 1, wherein the second visual content is formed from an object distal to the viewer.

9. The method for retarding or reversing the progression of myopia of a viewer according to claim 1, wherein the plurality of image planes generates myopic defocus.

10. A method for retarding or reversing the progression of myopia of a viewer, the viewer having an eye with a retina with a central region, comprising the steps of A) providing an immersive display unit comprising:
- i) a first display;
- ii) a first dioptric positive lens proximal to the first display;
- iii) a first fully-reflective mirror opposite the first dioptric positive lens from the first display;
- iv) a second display;
- v) a second dioptric positive lens proximal to the second display;
- vi) a semi-transparent mirror opposite the second dioptric positive lens from the second display; and
- vii) a second fully-reflective mirror distal from the first fully reflective mirror;

B) forming a primary visual content on the first display;

C) refracting the primary visual content through the first dioptric positive lens to form a primary optical channel;

D) redirecting the primary optical channel with the first fully-reflective mirror to the second fully-reflective mirror;

E) forming a secondary visual content on the second display;

F) refracting the secondary visual content though the second dioptric positive lens to form a secondary optical channel directed to the semi-transparent mirror;

G) reflecting the secondary optical channel off of the semi-transparent mirror;

H) converging the primary optical channel and the secondary optical channel into a converged optical channel; and I) reflecting the converged optical channel off of the second fully-reflective mirror, wherein the converged optical channel forms a plurality of image planes in the eye, wherein the image planes comprise a dioptric distance therebetween, and wherein the dioptric distance between the plurality of image planes is the greatest difference between the plurality of image planes.

11. The method for retarding or reversing the progression of myopia of a viewer according to claim 10, further comprising:

a third display;

a third dioptric positive lens proximal to the third display; and a second semi-transparent mirror opposite the second dioptric positive lens from the second display, and further comprising the steps of:

forming a tertiary visual content on the third display;

refracting the tertiary visual content though the third dioptric positive lens to form a tertiary optical channel directed to the second semi-transparent mirror;

reflecting the tertiary optical channel off of the second semi-transparent mirror; and converging the primary optical channel, the secondary optical channel, and the tertiary optical channel into a converged optical channel.

12. The method for retarding or reversing the progression of myopia of a viewer according to claim 10, wherein the dioptric distance is the greatest difference between the optical variance between the primary optical channel and the secondary optical channel.

13. The method for retarding or reversing the progression of myopia of a viewer according to claim 10, wherein the semi-transparent mirror is a pellicle mirror.

14. The method for retarding or reversing the progression of myopia of a viewer according to claim 10, wherein the plurality of image planes generates myopic defocus.

15. The method for retarding or reversing the progression of myopia of a viewer according to claim 10, further comprising the step of generating myopic defocus.

16. The method for retarding or reversing the progression of myopia of a viewer according to claim 10, wherein the plurality of image planes comprises a primary image plane comprising a primary image and a secondary image plane comprising a secondary image, and wherein the primary image is focused on the retina.

17. The method for retarding or reversing the progression of myopia of a viewer according to claim 10, wherein the plurality of image planes generates myopic defocus.

18. A non-immersive display unit comprising:

A) a display for forming a primary visual content;

B) a dioptric positive lens proximal to the display;

C) a fully-reflective mirror opposite the dioptric positive lens from the display; and D) a semi-transparent mirror distal from the fully-reflective mirror, wherein the primary visual content is refracted through the dioptric positive lens to form a primary optical channel, wherein the fully-reflective mirror redirects the primary optical channel to the semi-transparent mirror, wherein a secondary visual content is formed into a secondary optical channel, wherein the secondary optical channel is directed towards the semi-transparent mirror, wherein the semi-transparent mirror converges the primary optical channel and the secondary optical channel, into a converged optical channel, and wherein the converged optical channel forms a plurality of image planes in the eye.

19. An immersive display unit comprising:

A) a first display for forming a primary visual content;

B) a first dioptric positive lens proximal to the first display;

C) a first fully-reflective mirror opposite the first dioptric positive lens from the first display;

D) a second display for forming a secondary visual content;

E) a second dioptric positive lens proximal to the second display;

F) a semi-transparent mirror opposite the second dioptric positive lens from the second display; and G) a second fully-reflective mirror distal from the first fully reflective mirror, wherein the primary visual content is refracted through the first dioptric positive lens to form a primary optical channel, wherein the first fully-reflective mirror redirects the primary optical channel to the second fully-reflective mirror, refracting the secondary visual content through the second dioptric positive lens to form a secondary optic channel, wherein the secondary optical channel is directed to the semi-transparent mirror, wherein the semi-transparent mirror reflects the second optical channel, wherein the semi-transparent mirror converges the primary optical channel and the secondary optical channel into a converged optical channel, reflecting the converged optical channel off of the fully-reflective mirror, and wherein the converged optical channel forms a plurality of image planes in the eye.

20. A display system comprising the non-immersive display unit according to claim 18.

21. A display system comprising the immersive display unit according to claim 19.

* * * * *